US009394917B2

(12) United States Patent
Jankowski et al.

(10) Patent No.: US 9,394,917 B2
(45) **Date of Patent: *Jul. 19, 2016**

(54) COOLING DEVICES AND METHODS FOR USE WITH ELECTRIC SUBMERSIBLE PUMPS

(71) Applicant: Los Alamos National Security, LLC, Los Alamos, NM (US)

(72) Inventors: Todd A. Jankowski, Los Alamos, NM (US); Dallas D. Hill, Los Alamos, NM (US)

(73) Assignee: LOS ALAMOS NATIONAL SECURITY, LLC, Los Alamos, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/540,882

(22) Filed: Nov. 13, 2014

(65) Prior Publication Data

US 2015/0068230 A1 Mar. 12, 2015

Related U.S. Application Data

(63) Continuation of application No. 13/655,328, filed on Oct. 18, 2012, now Pat. No. 8,899,054.

(60) Provisional application No. 61/548,353, filed on Oct. 18, 2011.

(51) Int. Cl.

| | |
|---|---|
| ***F04D 29/58*** | (2006.01) |
| ***F25B 1/00*** | (2006.01) |
| ***F25B 41/00*** | (2006.01) |

(Continued)

(52) U.S. Cl.

CPC ..... *F04D 29/5806* (2013.01); *F04D 13/08* (2013.01); *F25B 1/005* (2013.01); *F25B 27/00* (2013.01); *F25B 41/00* (2013.01); *F25B 1/053* (2013.01); *F25B 2339/047* (2013.01); *F25B 2400/00* (2013.01); *F25B 2400/071* (2013.01)

(58) Field of Classification Search

CPC ..... B60H 1/00278; B60H 1/00907; B60H 2001/00307; B60H 2001/00949; B60H 2001/00957; B60H 2001/00935; F25B 1/005; F25B 30/02; F25B 41/00; F25B 1/053; F25B 2339/047; F25B 2400/071; F25B 2400/00; F04D 13/08; F04D 29/5806

USPC ..... 62/498, 260, 259.2, 84, 468

See application file for complete search history.

(56) References Cited

U.S. PATENT DOCUMENTS 1,947,630 A * 2/1934 Wernert ..... F04D 29/606 417/421

2,244,255 A * 6/1941 Looman ..... E21B 36/04 166/302

(Continued)

OTHER PUBLICATIONS

International Search Report from corresponding PCT Application No. PCT/US2012/60877 dated Jan. 11, 2013.

(Continued)

*Primary Examiner* — Mohammad M Ali

(74) *Attorney, Agent, or Firm* — King & Spalding LLP

(57) ABSTRACT

Cooling devices for use with electric submersible pump motors include a refrigerator attached to the end of the electric submersible pump motor with the evaporator heat exchanger accepting all or a portion of the heat load from the motor. The cooling device can be a self-contained bolt-on unit, so that minimal design changes to existing motors are required.

22 Claims, 6 Drawing Sheets

(51) Int. Cl.

| | |
|---|---|
| ***F04D 13/08*** | (2006.01) |
| ***F25B 27/00*** | (2006.01) |
| *F25B 1/053* | (2006.01) |

(56) References Cited

U.S. PATENT DOCUMENTS

| | | | | |
|---|---|---|---|---|
| 2,503,456 | A * | 4/1950 | Smith | F25B 30/06 62/260 |
| 3,443,641 | A * | 5/1969 | McComb | E21B 36/001 166/302 |
| 4,610,793 | A | 9/1986 | Miller | |
| 5,477,703 | A | 12/1995 | Hanchar et al. | |
| 5,694,780 | A | 12/1997 | Alsenz | |
| 6,561,775 | B1 * | 5/2003 | Wefers | F04C 13/008 417/423.3 |
| 6,769,487 | B2 * | 8/2004 | Hache | E21B 36/001 165/45 |
| 7,661,460 | B1 * | 2/2010 | Cowans | F28D 7/024 165/140 |
| 2003/0132003 | A1 | 7/2003 | Arauz et al. | |
| 2004/0112601 | A1 | 6/2004 | Hache | |
| 2004/0256109 | A1 * | 12/2004 | Johnson | F04B 47/08 166/369 |
| 2005/0089419 | A1 * | 4/2005 | Arauz | E21B 43/128 417/420 |
| 2009/0151928 | A1 | 6/2009 | Lawson | |
| 2009/0272129 | A1 * | 11/2009 | Petty | E21B 36/001 62/64 |
| 2010/0026108 | A1 * | 2/2010 | Hassett | H02K 9/20 310/54 |
| 2010/0115978 | A1 * | 5/2010 | Simka | F24D 3/18 62/238.7 |

OTHER PUBLICATIONS

Written Opinion of the International Search Authority from corresponding PCT Application No. PCT/US2012/60877 dated Jan. 11, 2013.

* cited by examiner

COOLING DEVICES AND METHODS FOR USE WITH ELECTRIC SUBMERSIBLE PUMPS

CROSS-REFERENCE TO RELATED APPLICATIONS

This application is a continuation of U.S. application Ser. No. 13/655,328, which was filed on Oct. 18, 2012, which claims the benefit of U.S. Provisional Application No. 61/548,353, which was filed on Oct. 18, 2011. The entire content of these applications is incorporated herein by reference in its entirety.

ACKNOWLEDGEMENT OF GOVERNMENT SUPPORT

This invention was made with government support under Contract No. DE-AC52-06NA25396, awarded by the U.S. Department of Energy. The government has certain rights in the invention.

TECHNICAL FIELD

This disclosure relates to cooling devices for use with electric submersible pump (ESP) systems.

BACKGROUND

Electrical submersible pumps (ESPs) are used in the geothermal, oil and gas and water wells for producing fluids from the subterranean well. Traditionally, subterranean wells are completed in porous formations having naturally high permeability and which contain water, oil, natural gas, heated water, brine and/or steam in relative close proximity to the surface of the earth. Geothermal wells are also completed in low permeability formations that contain little to no geothermal fluid. For these low permeability formations, the permeability of the formation is engineered or enhanced through stimulation methods such as pumping of cold water to generate fractures within the formation. This creates or enhances a geothermal reservoir in the high temperature formation to enable development of an Engineered or Enhanced Geothermal System (EGS).

Currently, ESP systems are not suitable for most high temperature applications, especially geothermal applications. ESP systems are susceptible to pump cavitation due to boiling in high temperature wells producing water and/or brine above 100° C. The temperature of the earth grows hotter with increasing depth, and geothermal systems can have well temperatures ranging from 150° C. to greater than 300° C. Advanced methods for recovering heavy oil may involve the use of steam to mobilize or heat oil and water produced from the reservoir having a temperature above 200° C. ESP systems used to recover oil with hot water in these steam flood wells are exposed to temperatures above design limits of current ESPs.

ESPs are comprised of two main parts, an electric induction motor and a centrifugal pump. The electric motor is used to drive the pump. The motors and pumps both have small aspect ratios (diameter to length ratio), typically 5-10 inches in diameter and 10-30 feet long. The pumps are used downhole in oil-field applications to pump oil from reservoirs to the surface. The ESP is placed in an oil well typically hundreds to thousands of feet underground. Oil producers have been using ESPs in Steam-Assisted oil-field applications, where the motors and pumps are operating in reservoirs with temperatures exceeding 400° F. As a result of heat generated on the interior of the motor (due to electrical and windage losses) during operation, the interior of the motor may reach temperatures significantly hotter (between 50°-100° F.) than the reservoir temperature.

ESP manufacturers all produce a line of 'high temperature ESPs' that are specifically designed to operate in high temperature environments. The design enhancements used in the current state of the art high temperature ESPs primarily focus on material selection (epoxies and insulation) in the motor, so that the electrical components can operate at elevated temperatures. Despite these design enhancements, thermal failures of ESPs are still a significant cost to oil production companies and a significant portion of total production is at risk from ESP failure.

Empirical evidence shows a strong correlation between a reduction in motor operating temperature and increased run life. Empirical evidence from the industry suggests that a 20° F. reduction in peak motor temperature could result in a 50% increase in run life. For ESP motors during operation, the interior components of the motor typically operate at temperatures 50-100° F. higher than the surrounding reservoir temperature. However, if a downhole cooling device (e.g., a refrigerator) can be used to provide a low temperature heat sink downhole, and depending on the capacity of the refrigerator, the internal components of the motor could be cooled to the reservoir temperature or even lower, with proportionate increases in run life.

SUMMARY

Various cooling devices are disclosed herein for use with ESP systems to provide improved performance and functionality of the ESP systems in high temperature environments.

In one embodiment, a cooling device for an electric submersible pumping system is provided. The cooling device can have a generally cylindrical housing having a first end, a second end, a length defined as the distance between the first end and the second end, and a diameter. In addition, the cooling device can include a compressor, a condenser, an expansion valve, an evaporator contained within the housing, and a coupling system for powering the compressor from a motor on the electric submersible pumping system.

In some embodiments, the coupling system can be a magnetic coupling system positioned at the first end of the generally cylindrical housing. The magnetic coupling system can have a first side that can be driven by a motor of the electric submersible pumping system and a second side that can drive a shaft of the compressor. In other embodiments, the generally cylindrical housing can include a compressor housing coupled to an evaporator housing, with the compressor housing generally covering the compressor and the evaporator housing generally covering the evaporator. The compressor housing can include a metal plate that forms part of the magnetic coupling system. The compressor housing can include a plurality of passageways extending from a first side of the compressor housing to a second side of the compressor housing, with the passageways being sized to allow a lubricating fluid from the motor (e.g. oil) to bypass the compressor and flow between the motor of the electric submersible pumping system and the evaporator.

In some embodiments, the evaporator can include a plurality of tubes that substantially extend the length of evaporator housing. The plurality of tubes can have an outer tube, an inner tube, and an annulus defined therebetween. One or more oil supply manifolds can be coupled to the inner tube and the expansion valve can be fluidly coupled to the outer tube to deliver a working fluid (e.g., steam) to the annulus between the inner and outer tubes.

In some embodiments, the compressor can be a reciprocating compressor or a vane compressor. The condenser can be a single-pass heat exchanger which rejects heat to an external product stream through the condenser housing. The condenser housing can be finned to facilitate the transfer for heat to the product stream. In some embodiments, the ratio of the length to the diameter of the generally cylindrical housing is at least 15:1 or, in other embodiments, at least 30:1.

In another embodiment, a method of cooling a lubricating fluid in a downhole electric submersible pumping system is provided. The method includes coupling a cooling device to the electric submersible pumping system. The cooling device can include a compressor, a condenser, an expansion valve, and an evaporator contained within a generally cylindrical housing. The method further includes operatively coupling the cooling device to a motor on the electric submersible pumping system to drive a shaft of the compressor, positioning the cooling device downhole with the electric submersible pumping system, operating the electric submersible pumping system, and cooling the lubricating fluid using the cooling device.

In some embodiments, the act of coupling the cooling device to the electric submersible pumping system comprises bolting the two together. The act of operatively coupling the cooling device and the electric submersible pumping system can include coupling a first side of a magnetic coupling system to the motor of the electric submersible pumping system and coupling a second side of the magnetic coupling system to a shaft of the compressor. The act of cooling the lubricating fluid in the motor of the electric submersible pumping system can include receiving the lubricating fluid from the motor into an inner tube of the evaporator, delivering a working fluid (e.g., steam) in an outer tube of the evaporator that generally surrounds the inner tube, and returning the lubricating fluid from the inner tube of the evaporator back into the motor at a temperature lower than the temperature in which entered the inner tube.

In some embodiments, the acts of receiving and returning the lubricating fluid to and from the inner tube, respectively, comprise bypassing the compressor by delivering the lubricating fluid through a plurality of passageways in the housing. The length of the housing can be at least 15 times the diameter of the housing and the act of cooling the lubricating fluid can include directing the lubricating fluid along a majority of the length of the housing within the inner tube. The condenser can be a single-pass heat exchanger and the method can include rejecting heat from the condenser to a product stream external to the housing.

In another embodiment, a bolt-on refrigerator system is provided. The system includes a generally cylindrical housing, a compressor, and a magnetic coupling system. The generally cylindrical housing has a first end, a second end, a length defined as the distance between the first end and the second end, and a diameter. The generally cylindrical housing also includes a compressor housing portion and a finned evaporator housing portion. The compressor is in the compressor housing portion and a condenser, an expansion valve, and an evaporator contained are within a finned evaporator housing portion. The magnetic coupling system is positioned at the first end of the generally cylindrical housing and the magnetic coupling system has a first side that can be driven by an external device and a second side that can drive a shaft of the compressor. The ratio of the length to the diameter of the generally cylindrical housing can be at least 15:1, or in other embodiments, at least 30:1.

In some embodiments, an electric submersible pumping system is coupled to the first end of the bolt-on refrigerator. The electric submersible pumping system includes a motor as the external device that can drive the first side of the magnetic coupling system. A plurality of passageways extending from a first side of the compressor housing to a second side of the compressor housing can also be provided. The passageways can be sized to allow a lubricant from the motor of the electrical submersible pumping system to bypass the compressor and flow between the motor of the electric submersible pumping system and the evaporator.

In other embodiments, an active on-board cooling device (e.g., a refrigerator) for an ESP motor is provided for operating in a SAGD environment. The refrigerator can provide a low temperature heat sink downhole. When the heat generating components of the motor are allowed to communicate with this low temperature heat sink, the internal components of the ESP motor can operate at temperatures significantly lower than an ESP without the on-board refrigerator. These operating temperature reductions can provide increased reliability and longer run times.

DETAILED DESCRIPTION

The following description is exemplary in nature and is not intended to limit the scope, applicability, or configuration of the invention in any way. Various changes to the described embodiments may be made in the function and arrangement of the elements described herein without departing from the scope of the invention.

As used in this application and in the claims, the terms "a," "an," and "the" include both the singular and plural forms of the element(s) they refer to unless the context clearly dictates otherwise. Additionally, the term "includes" means "comprises." Further, the term "coupled" generally means electrically, electromagnetically, and/or physically (e.g., mechanically or chemically) coupled or linked and does not exclude the presence of intermediate elements between the coupled or associated items absent specific contrary language. Although water/steam is described in certain embodiments, it should any working fluid with suitable characteristics for a particular application can be used with the cooling devices described herein (e.g., a refrigerator).

Although the operations of exemplary embodiments of the disclosed method may be described in a particular, sequential order for convenient presentation, it should be understood that disclosed embodiments can encompass an order of operations other than the particular, sequential order disclosed. For example, operations described sequentially may in some cases be rearranged or performed concurrently. Further, descriptions and disclosures provided in association with one particular embodiment are not limited to that embodiment, and may be applied to any embodiment disclosed.

Cooling devices for Electric Submersible Pumps (ESPs) are described herein. As described in more detail below, these cooling devices can remove all or at least a portion of the heat load from an ESP motor to lower the internal temperature of the motor and improve its reliability.

Figure 1A:
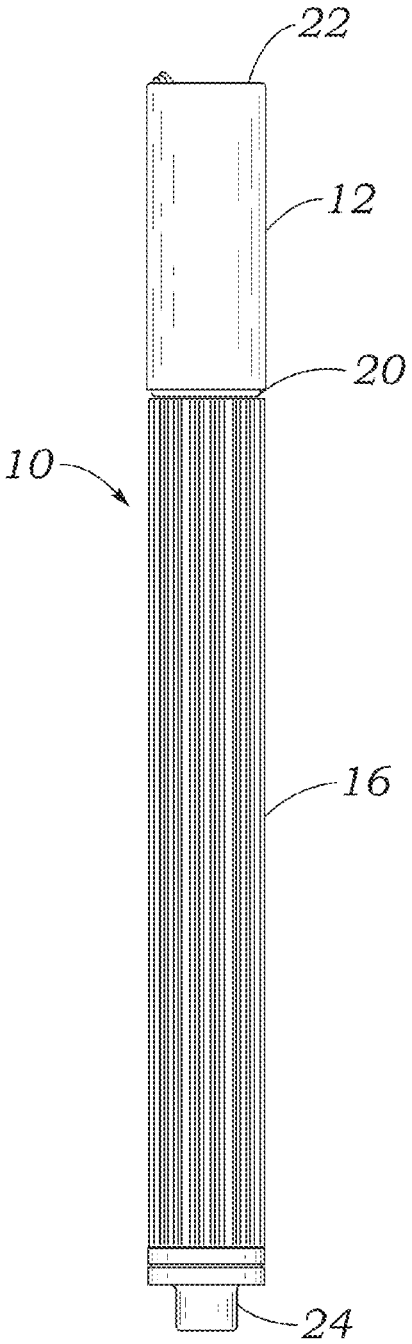
FIG. 1A shows a view of a cooling device for use with an ESP system.
Figure 1B:
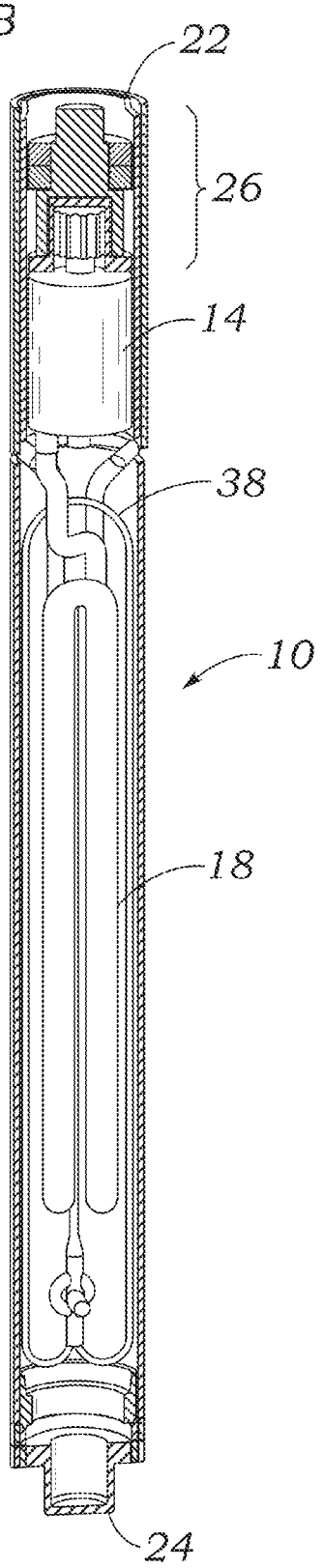
FIG. 1B shows a sectional view of the cooling device shown in FIG. 1A.

FIGS. 1A and 1B illustrate views of a cooling device 10, with FIG. 1B being a cross-sectional view of FIG. 1A. It should be understood that cooling device 10 is not drawn to scale in the figures. In particular, the evaporator and condenser sections (e.g., heat exchanger system 18 shown in FIG. 1B) of cooling device 10 have been significantly shortened relative to other features to allow for easier viewing.

In one embodiment, cooling device 10 can be between about 4 and 8 inches in diameter and between 10 and 50 feet long. In a particular embodiment, cooling device 10 can be between about 5.5 and 6.5 inches in diameter and between about 20 and 40 feet long, or more preferably between about 25 and 35 feet long, such as about 6 inches and about 30 feet long. Thus, the ratio of the length to diameter of cooling devices described herein is at least 15:1 (e.g., 8 inches and 10 feet long), and in some embodiments, at least 30:1 (e.g., 8 inches and 20 feet long).

Referring to FIGS. 1A and 1B, cooling unit 10 can be formed to have a plurality of housings that cover, contain, and/or otherwise protect internal areas of cooling unit 10. For example, a compressor housing 12 can cover or contain a compressor system 14. In addition, a second housing, such as finned housing 16, can generally cover a heat exchanger system 18. Housings 12 and 16 can be coupled together, such as by weld joint 20. A first end 22 of cooling device 10 can be configured to be coupled to an ESP system, and the second end can have an end cap 24.

Cooling device 10 can comprise a refrigerator system (e.g., a system that has a compressor, condenser, evaporator, and expansion valve) that can be bolted to the end of the ESP motor (not shown) near compressor system 14. In some embodiments, cooling device 10 can be bolted to the ESP motor using a standard flange.

Figure 2:
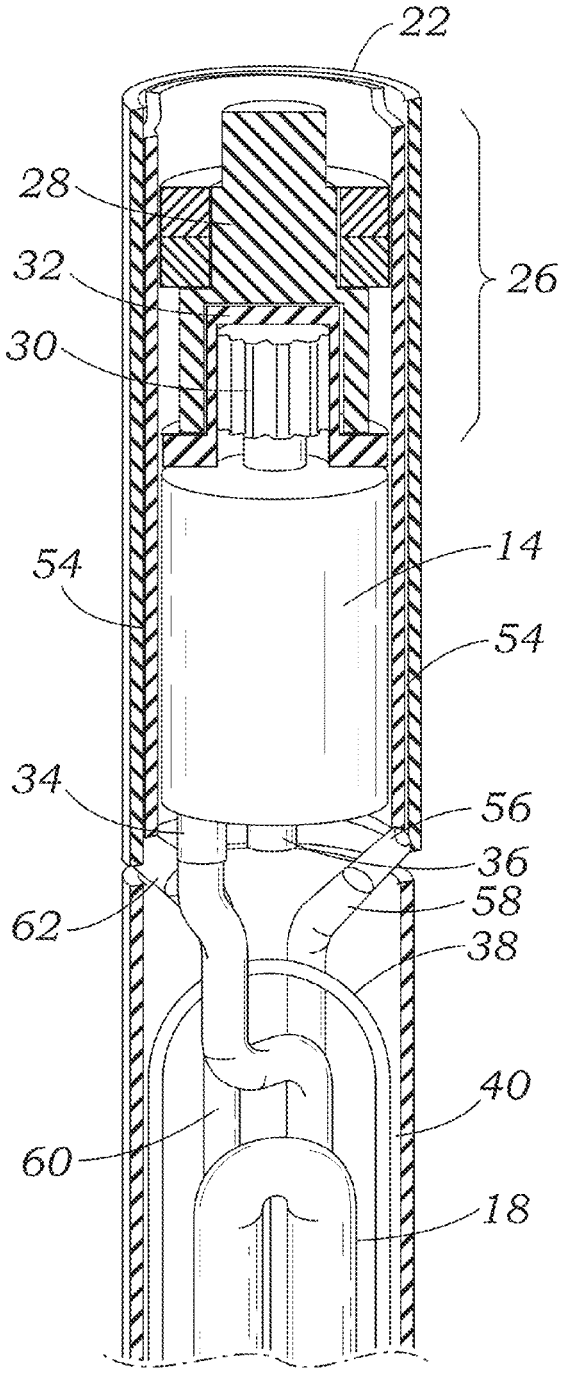
FIG. 2 shows a close-up view of the compressor in the cooling device.

As shown in FIGS. 1A and 2, compressor system 14 can be driven by a magnetic coupling 26. In particular, a female side 28 of magnetic coupling 26 (shown in at the top of FIG. 2) can be driven by the existing motor shaft of the ESP system using a standard spline coupling. A male side 30 of the magnetic coupling 26 can be configured to drive a shaft of compressor system 14.

Figure 5:
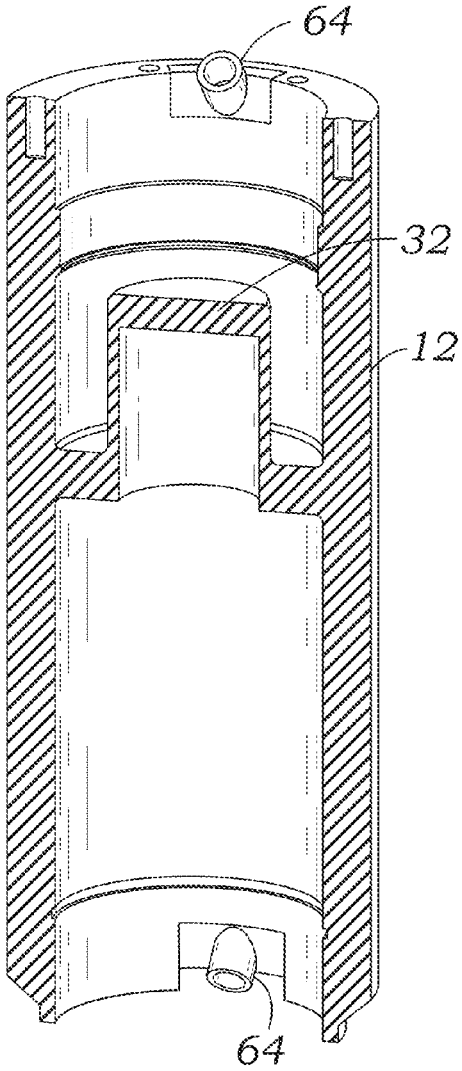
FIG. 5 shows a view of the compressor housing without the compressor or magnetic coupling.

Between the male and female sides 30, 28 of the coupling 26 is a metal plate 32 (e.g., a stainless steel plate). Plate 32 can be machined directly from compressor housing 12. As shown in FIG. 5, plate 32 can be positioned between the two sections of magnetic coupling 26, thereby acting as a pressure boundary between a working fluid (e.g., steam) and an internal motor lubricating fluid (e.g., oil). In this manner, plate 32 forms a portion of the hermetic seal between the working fluid (e.g., steam) and the internal motor oil. In some embodiments, all surfaces separating the working fluid (e.g., steam) and oil are made with welded connections, thereby preventing the working fluid (e.g., steam) steam from contaminating the internal motor oil. As discussed above, the following embodiments describe the working fluid as water/steam; however, it should be understood that, depending on the particular conditions of operation, other suitable working fluids can be used in combination with the cooling devices described herein. For example, water/steam can be well-suited for operation at temperatures, for example, of about 150-250 degrees Celsius, but other working fluids could be more desirable if the cooling device is to be used at temperatures outside of this range.

Magnetic coupling 26 can be based on a design available through MMC Enterprises Corporation, however any suitable coupling may be used. The coupling can be sized for the torque requirements of compressor system 14. For example, in one embodiment, coupling 26 can be selected so that it will function at 3600 rpm and at a working temperature of up to 280° C.

Figure 3:
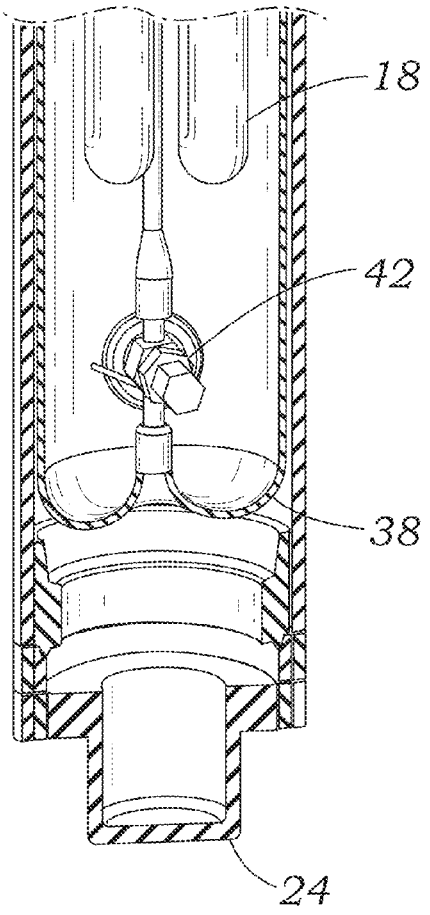
FIG. 3 shows a close-up view of the end of the cooling device with the expansion valve.

Referring again to FIG. 2, steam inlet 34 and steam outlet 36 are provided for receiving and delivering a refrigerator working fluid such as water. These connections to compressor system 14 can be located at the end opposite the drive shaft of the compressor system 14, as shown in FIG. 2. Thus, high temperature steam leaving the compressor outlet 36 can flow over a domed head of a condenser shell 38 and into an annulus 40 between condenser shell 38 and the housing 16 of cooling device 10. As the high temperature vapor enters annulus 40, heat is rejected from the steam through housing 16 of cooling device 10 to an external product stream that flows past housing 16. The resulting high temperature liquid can collect at an outlet of the condenser shown at the bottom of FIG. 3.

Figure 4:
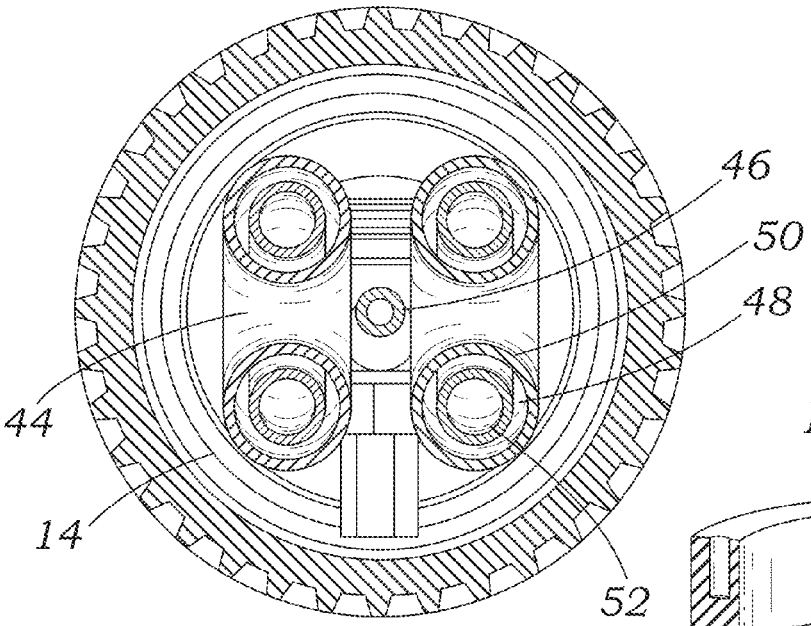
FIG. 4 shows a cross-section of the heat exchanger portion of the cooling device showing the evaporator and condenser heat exchangers.

The high temperature liquid then flows through a pressure drop in an expansion valve 42. The low temperature liquid-vapor mixture at the outlet of expansion valve 42 is then routed into the evaporator heat exchanger system 18. The low temperature steam leaving expansion valve 42 is routed through the four-pass tube-in-tube evaporator heat exchanger 44 shown in FIG. 4. From expansion valve 42, the steam first flows through a steam supply tube 46 at the center of the evaporator tube bundle along the full length of the evaporator heat exchanger system 18. At the compressor system 14 end of the heat exchanger system 18, the steam flows into an annulus 48 between an outer steam tube 50 and a tube 52 carrying the motor oil from the ESP. In the annular tube-in-tube section, heat generated in the motor and transferred to the motor oil is transferred from the motor oil to the low temperature steam on the steam side of the evaporator. The tube-in-tube section makes four passes through the evaporator section. At the end of the fourth pass, the steam is routed back to compressor inlet 34, and the low temperature oil flows back into the motor as described in more detail below. That is, FIG. 4 illustrates an evaporator 44 comprising a plurality of tubes, the plurality of tubes having an outer tube 50, an inner tube 52, and an annulus 48 defined therebetween.

Figure 6:
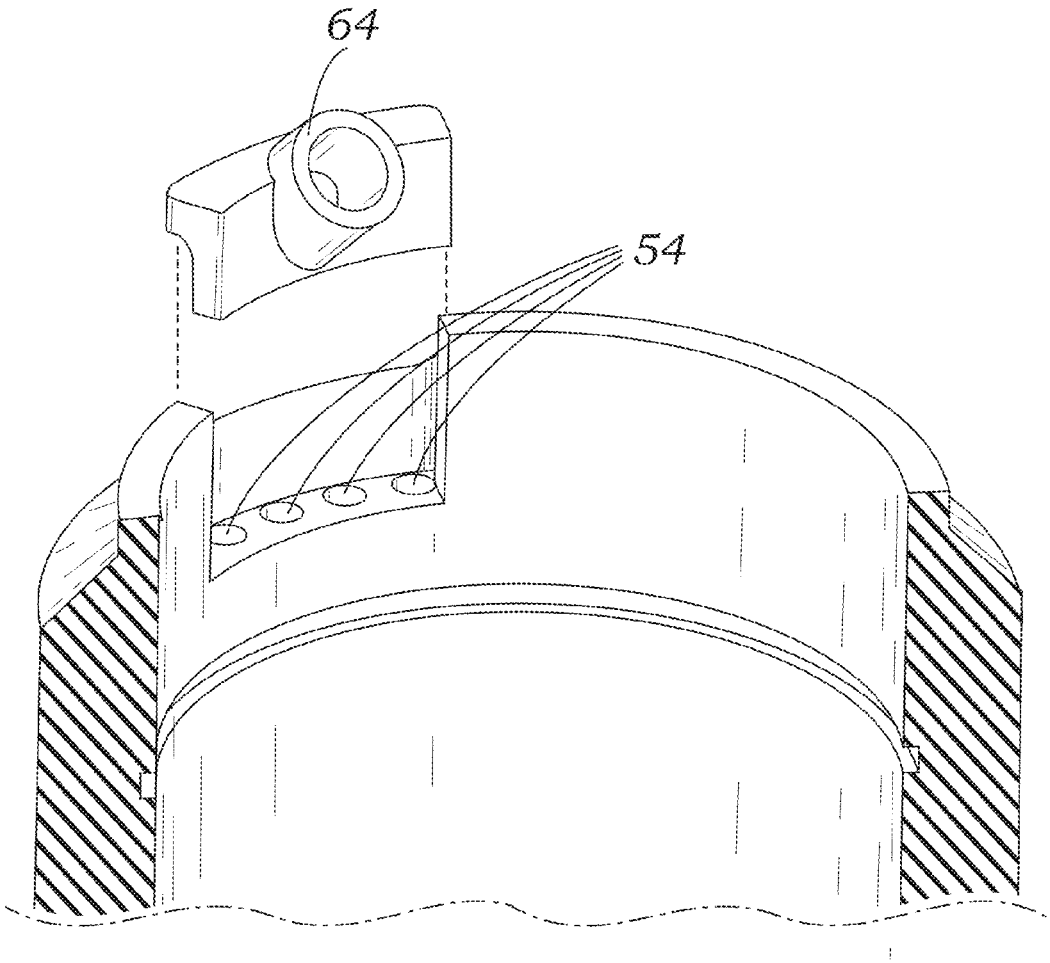
FIG. 6 shows close-up exploded view of the compressor housing with the manifold.

To allow for heat transfer between the steam and the motor oil in the evaporator, the motor oil must flow past the compressor. As shown in FIG. 2, FIG. 5, and FIG. 6 the compressor housing 14 can have one or more passageways 54 (e.g., small axial channels drilled into the housing wall) for oil flow past compressor 14 in each direction. In one embodiment a total of 10¼" diameter passageways (5 on the oil supply and 5 on the oil return) are incorporated into the housing to allow for a substantial flow cross-sectional area to minimize pressure drop in the oil. Oil can be delivered to the evaporator via oil supply passageways 54 to an oil supply manifold 56 and into an oil supply tube 58. To return oil from the evaporator, oil can return through an oil return tube 60, to an oil return manifold 62, and into oil return passageways 54.

As shown in FIG. 6, manifolds 64 (which include oil supply and return manifolds 56, 62) can be provided on either end of compressor 14 to collect the oil from these passageways and to route the oil as necessary. These oil flow passages through the compressor housing 12 allow oil flow from the ESP motor to evaporator heat exchanger system 18.

The cooling device components described herein were developed with the intent of meeting heat transfer, pressure, and assembly requirements. In some embodiments, the refrigerator components can be welded together to ensure that the cooling device does not fail in view of the high differential pressure between the product and steam. In addition, compressor 14 can require most of the internal diameter of the compressor housing 12 which can complicate the oil manifold shown in FIG. 6.

In one embodiment, the compressor housing 12 (including plate 32) can be machined out of a single stainless steel rod, with small bypass holes drilled into compressor housing 12 to allow for oil exchange across housing 12. If desired, a manifold adapter can be welded into housing 12 to connect the bypass holes after the compressor is installed to provide improved structural strength.

Based on the requirements of the cooling device, although other compressors may be used, two types of compressors are preferred. The two preferred compressor types are rotary vane and swash or wobble plate reciprocating. Lubricants which are compatible with steam and capable of withstanding the operating temperatures are preferably used with the cooling device.

As discussed above, the cooling systems disclosed herein can be easily coupled to existing ESP systems. For example, the cooling systems can simply be bolted onto high temperature ESPs. In addition, a mechanical interface for the refrigerator add-on can be provided, such as a spline coupling to the motor shaft to drive the refrigerator's compressor and lubricating oil circulation pump. Currently, ESPs in production are already equipped with this type of spline coupling at the end of the motor to allow for the use of multiple motors in series. The cooling devices described herein take advantage of current configurations of ESP so that they can be readily coupled to the ESPs as, for example, a bolt-on accessory.

An exemplary method of operation of a bolt-on cooling device (e.g., a single stage vapor compression refrigerator with a four component cycle) is described below.

Once coupled to the ESP motor as described above, the vapor compressor of the refrigerator compresses a working fluid (preferably water) from saturated vapor at a low temperature and pressure to a high pressure superheated vapor. The high temperature working fluid can then be directed through a condenser heat exchanger that rejects heat to the reservoir fluids flowing past the motor and refrigerator. Heat rejection from the condenser heat exchanger causes the working fluid to de-superheat and condense to a saturated or slightly subcooled condition at the condenser outlet.

The high temperature liquid working fluid can then be directed through an expansion valve, which causes a reduction in pressure of the working fluid and a corresponding reduction in temperature. The fluid at the exit of the expansion valve is a low temperature two-phase liquid-vapor mixture. This low temperature two-phase mixture can then be routed through an evaporator heat exchanger, where heat can be accepted from a higher temperature heat source such as the internal lubricating oil of the ESP motor that is in contact with the heat generating components of the motor. Heat transfer from the heat source to the working fluid in the evaporator causes the working fluid to evaporate. The fluid leaving the evaporator heat exchanger is a saturated or slightly superheated low temperature vapor that then re-enters the compressor to begin another cycle.

In one embodiment, the evaporator heat exchanger can use a shell and tube heat exchanger with the refrigerant on the tube side and the motor's lubricating oil on the shell side. To transport heat from the heat generating components of the motor to the evaporator heat exchanger, an internal lubricating oil pump can be included on the shell side to circulate the oil axially between the motor and the refrigerator. The condenser heat exchanger can be a falling film design that would give the working fluid a surface to condense; the outside of the condensing surface being cooled by the reservoir fluids flowing axially past the motor housing. The expansion valve can be an orifice type expansion device. The compressor can bleed power from the main rotating shaft of the motor. This compressor could be any type of rotary compressor that would fit in the limited diameter of the ESP motor.

Figure 7A:
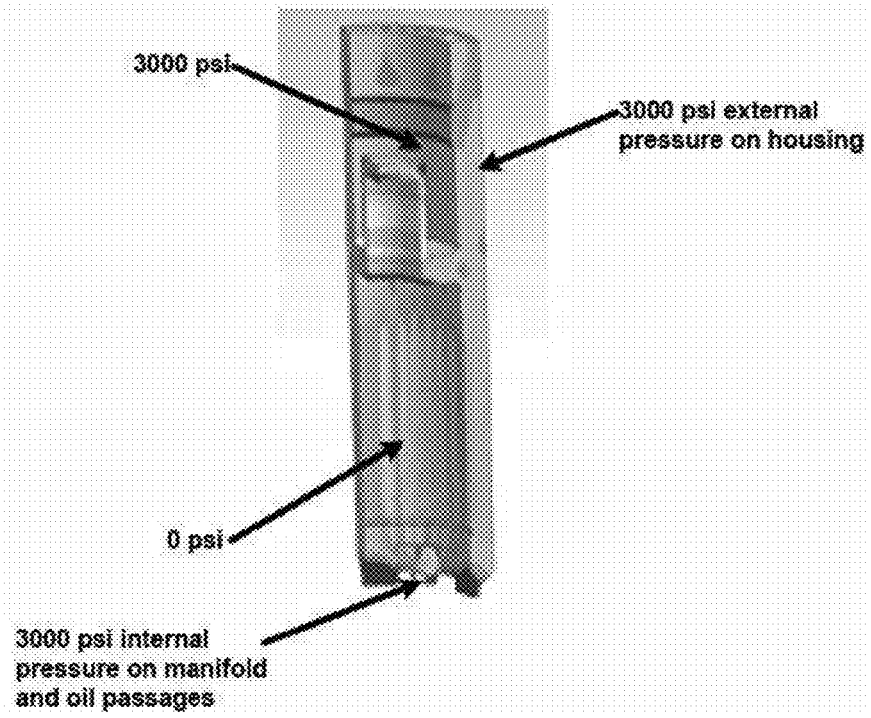
FIGS. 7A and 7B show stress analyses that were performed on components subjected to high pressure.

A finite element structural analysis of the finned refrigerator housing has been performed and the results of the finite element analysis are shown in FIG. 7A. As shown in those figures, maximum stress in the wall of the housing with a 3000 psi external pressure (and 0 psi internal pressure) is calculated as 34 ksi. The yield strength of the carbon steel housings is 75 ksi. The stresses generated in the wall of the finned housing are well below the yield strength of the material.

Figure 7B:
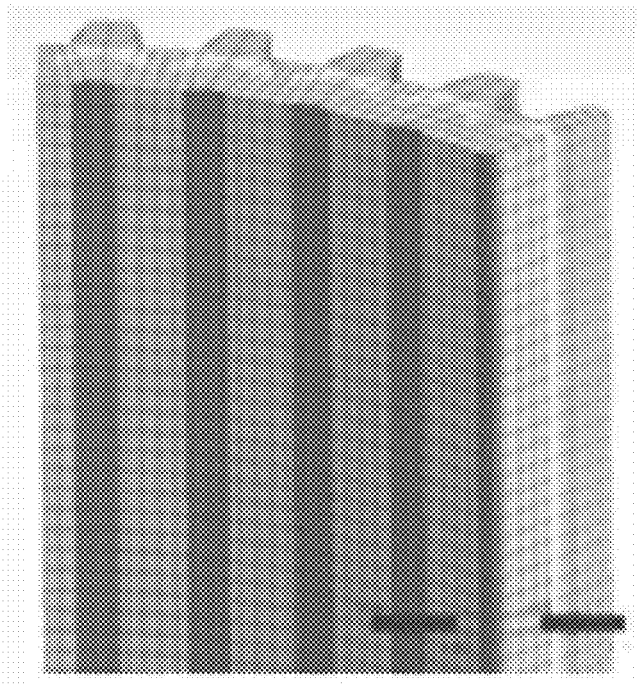

A finite element analysis of the compressor housing has also been performed. Results of that analysis are shown in FIG. 7B. The maximum stress calculated in the analysis is 61 ksi; however, this maximum stress is a local stress concentration, likely at one of the sharp corners in the design. The scale has been adjusted in the figure so that the maximum stresses shown are 25 ksi. Large areas in the housing reach this maximum stress level. Compressor housing 12 can be machined from a stainless steel rod with a yield strength of (typically) 45 ksi. The stresses in the compressor housing are again well below the yield strength of the housing material.

Figure 8:
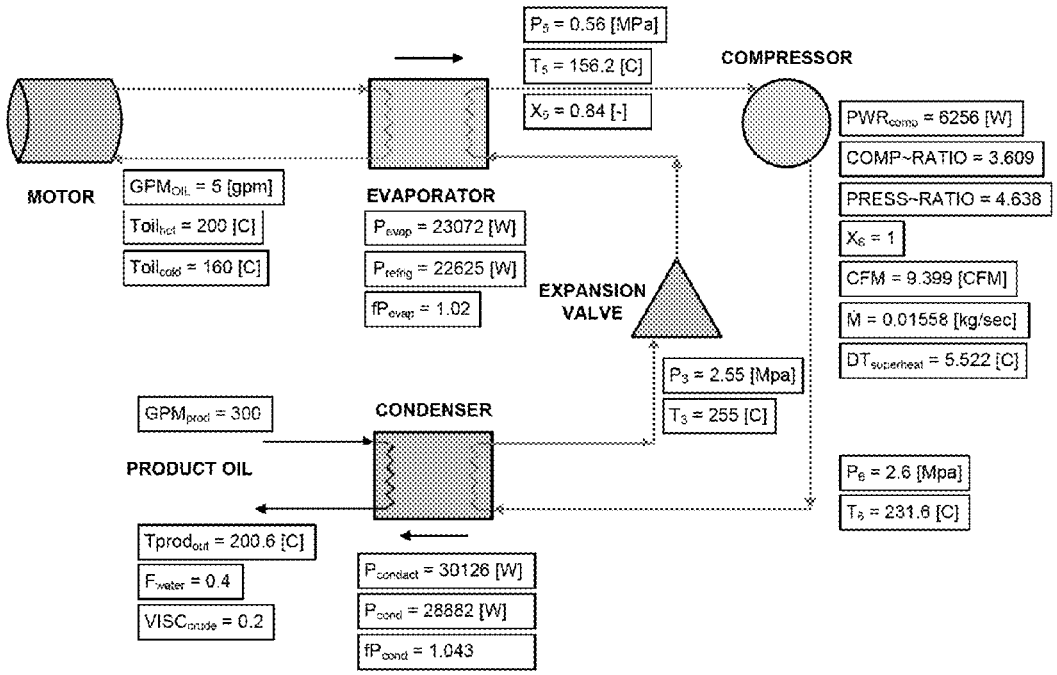
FIG. 8 shows calculations performed to assess operating conditions.

The cooling devices described herein remove heat from internal motor oil to permit the ESP to operate at lower temperatures. By consuming energy directly from the ESP motor to drive the compressor, the cooling devices described herein do not require a separate motor source for operation. At high temperatures in the condenser heat exchanger, the cooling devices can transfer to the product stream a heat load equal to the total heat load absorbed from the motor oil in the evaporator plus the work supplied to the compressor. To determine flow rates, temperatures, pressures, and refrigeration loads, a computer program was developed to calculate all of the state points in the thermodynamic cycle. FIG. 8 shows a block diagram of the cycle. It is taken from the EES (Engineering Equation Solver) code that calculates the cycle parameters. The variables shown are linked to the code and change as the code parameters are manipulated. In this example case, the key inputs are the steam quality at the compressor inlet (84%), the product water cut (40%) and the product viscosity (90 cp). Units are generally metric.

The EES program includes not only a calculation of the steam state points at various points in the thermodynamic cycle but also heat transfer calculations for the condenser and evaporator heat exchangers. With the product oil and internal motor oil flow rates and temperatures, the program calculates the heat transfer capacity (the amount of heat transfer that the heat exchanger is capable of) based on the available heat exchanger area for a refrigerator that will fit in the 30 ft length requirement. The heat transfer calculations are for the tube-in-tube evaporator design and the condenser with a finned housing. In FIG. 8, $P_{evap}$ is the refrigeration load that the evaporator heat exchanger can provide while $P_{refrig}$ is what is required to cool the internal motor oil by 40° C. with the oil flowing past the evaporator coils at 5 gpm. The ratio of the two of $fP_{evap}\approx 1.0$ shows that the evaporator is sized correctly. Similarly, $P_{condact}$ is the heat transfer rate that the condenser heat exchanger can reject to the product stream while $P_{cond}$ is what is required by the thermodynamic cycle. When $fP_{cond}>1.0$, the condenser is oversized. When $fP_{cond}<1.0$, the condenser is undersized. For the example shown in FIG. 8, both the evaporator and condenser heat exchangers have sufficient capacity to transfer the required heat loads.

As illustrated in FIG. 8, 22.6 kW are required to cool the internal motor oil from 200° C. to 160° C. in the evaporator heat exchanger. Thus, the refrigerator sized in FIG. 8 is extracting a considerable portion of the 28 kW total heat generation rate in the baseline ESP motor. To achieve this refrigeration capacity, the compressor must consume 6.3 kW or 8.4 hp. The compressor's power consumption was calculated assuming a compressor isentropic efficiency of 66%, which is typical of a reciprocating compressor. This power will be directly extracted from the ESP motor. Our baseline motor is a 228 hp motor. Therefore, the refrigerator will consume less than 5% of the total motor output.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A cooling device for an electric submersible pumping system, the cooling
device comprising:
a generally cylindrical housing having a first end, a second end, a length defined as the distance between the first end and the second end, and a diameter;
a compressor, a condenser, an expansion device, and an evaporator contained within the housing; and
a coupling system for coupling the compressor to the electric submersible pumping system.

2. The cooling device of claim 1, wherein the coupling system couples the compressor to a motor on the electric submersible pumping system.

3. The cooling device of claim 1, wherein the coupling system comprises a magnetic coupling system positioned at the first end of the generally cylindrical housing, the magnetic coupling system having a first side that can be driven by a motor of the electric submersible pumping system and a second side that can drive a shaft of the compressor.

4. The cooling device of claim 3, wherein the generally cylindrical housing comprises a compressor housing coupled to an evaporator housing, the compressor housing generally covering the compressor and the evaporator housing generally covering the evaporator.

5. The cooling device of claim 4, wherein the compressor housing comprises a metal plate that forms part of the magnetic coupling system.

6. The cooling device of claim 4, wherein the compressor housing comprises a plurality of passageways extending from a first side of the compressor housing to a second side of the compressor housing, the passageways being sized to allow oil to bypass the compressor and flow between the motor of the electric submersible pumping system and the evaporator.

7. The cooling device of claim 4, wherein the evaporator comprises a plurality of tubes that substantially extend the length of evaporator housing, the plurality of tubes having an outer tube, an inner tube, and an annulus defined therebetween.

8. The cooling device of claim 7, further comprising one or more oil supply manifolds coupled to the inner tube, wherein the expansion device is fluidly coupled to the outer tube to deliver a working fluid to the annulus between the inner and outer tubes.

9. The cooling device of claim 1, wherein the compressor is either a reciprocating compressor or a vane compressor.

10. The cooling device of claim 4, wherein the condenser is a single-pass heat exchanger which rejects heat to an external product stream through the condenser housing.

11. The cooling device of claim 10, wherein the condenser housing is finned to facilitate the transfer for heat to the product stream.

12. The cooling device of claim 1, wherein the cooling device additionally comprises one or more lubricating fluid supply passageways which extend from the coupling system into the cooling device.

13. A method of cooling a lubricating fluid in a downhole electric submersible pumping system, comprising:
operatively coupling a cooling device to the electric submersible pumping system, the cooling device comprising a compressor, a condenser, an expansion device, and an evaporator contained within a generally cylindrical housing;
positioning the cooling device downhole with the electric submersible pumping system;
operating the electric submersible pumping system; and
cooling the lubricating fluid using the cooling device.

14. The method of claim 13, wherein the act of cooling the lubricating fluid in the motor of the electric submersible pumping system comprises:
receiving the lubricating fluid from a motor into an inner tube of the evaporator;
delivering a working fluid in an outer tube of the evaporator, the outer tube generally surrounding the inner tube; and
returning the lubricating fluid from the inner tube of the evaporator back into the motor at a temperature lower than the temperature in which entered the inner tube.

15. The method of claim 14, wherein the acts of receiving and returning the lubricating fluid to and from the inner tube, respectively, comprise bypassing the compressor by delivering the lubricating fluid through a plurality of passageways in the housing.

16. The method of claim 14, wherein the length of the housing is at least 15 times the diameter of the housing, wherein the act of cooling the lubricating fluid comprises directing the lubricating fluid along a majority of the length of the housing within the inner tube.

17. The method of claim 14, wherein the condenser is a single-pass heat exchanger, the method further comprising rejecting heat from the condenser to a product stream external to the housing.

18. The method of claim 13, wherein the cooling device additionally comprises one or more lubricating fluid passageways.

19. The method of claim 18, wherein the method additionally comprises circulating the lubricating fluid from the electric submersible pumping system into the one or more lubricating fluid passageways of the cooling device.

20. A refrigerator system comprising:

a generally cylindrical housing having a first end, a second end, a length defined as the distance between the first end and the second end, and a diameter, the generally cylindrical housing including a compressor housing portion and a finned evaporator housing portion;

a compressor in the compressor housing portion;

a condenser, an expansion device, and an evaporator contained within the finned evaporator housing portion; and a coupling system positioned at the first end of the generally cylindrical housing, the coupling system having a first side that can be driven by an external device and a second side that can drive a shaft of the compressor, wherein the ratio of the length to the diameter of the generally cylindrical housing is at least 15:1.

21. The refrigerator system of claim 20, further comprising:

an electric submersible pumping system coupled to the first end of the refrigerator, the electric submersible pumping system comprising a motor, the motor being the external device that can drive the first side of the coupling system; and a plurality of passageways extending from a first side of the compressor housing to a second side of the compressor housing, the passageways being sized to allow a lubricant from the motor of the electrical submersible pumping system to bypass the compressor and flow between the motor of the electric submersible pumping system and the evaporator.

22. The refrigerator system of claim 20, wherein the refrigerator system additionally comprises one or more lubricating fluid passageways extending from the coupling system into the refrigerator system.

* * * * *